US007997018B1

(12) United States Patent
Harvey

(10) Patent No.: US 7,997,018 B1
(45) Date of Patent: Aug. 16, 2011

(54) DEVICES AND METHODS OF FACILITATING COOKING AND IRONING USING VIBRATION PULSES

(75) Inventor: Leonard W. Harvey, Downingtown, PA (US)

(73) Assignee: Lenford, Inc., Elverson, PA (US)

( * ) Notice: Subject to any disclaimer, the term of this patent is extended or adjusted under 35 U.S.C. 154(b) by 337 days.

(21) Appl. No.: 12/238,024

(22) Filed: Sep. 25, 2008

Related U.S. Application Data

(60) Provisional application No. 60/977,856, filed on Oct. 5, 2007.

(51) Int. Cl.
*D06F 75/00* (2006.01)
*D06F 75/08* (2006.01)

(52) U.S. Cl. ..... 38/74; 38/75

(58) Field of Classification Search ..... 38/88, 93, 38/74, 77.7, 96, 97, 75
See application file for complete search history.

(56) References Cited

U.S. PATENT DOCUMENTS

| | | | | |
|---|---|---|---|---|
| 1,630,115 | A | 5/1927 | DuPrey | |
| 1,864,010 | A * | 6/1932 | Becket | 38/74 |
| 1,960,424 | A | 5/1934 | Voss | |
| 2,040,936 | A | 5/1936 | Hart | |
| 2,080,682 | A | 5/1937 | Yoerg | |
| 2,476,663 | A | 7/1949 | Holden | |
| 2,829,528 | A | 4/1958 | Hulick, Jr. | |
| 3,603,224 | A * | 9/1971 | Dresher | 404/133.1 |
| 3,623,481 | A | 11/1971 | Curran | |
| 3,635,150 | A | 1/1972 | Piedallu | |
| 3,688,684 | A | 9/1972 | Piedallu | |
| 3,914,834 | A | 10/1975 | Hatay | |
| 4,035,878 | A | 7/1977 | Cheatham | |
| 4,203,357 | A | 5/1980 | Vaussanvin | |
| 4,417,506 | A | 11/1983 | Herbst et al. | |
| 4,522,117 | A | 6/1985 | Weimer et al. | |
| 4,561,346 | A | 12/1985 | Marquer | |
| 4,598,635 | A | 7/1986 | Clegg | |
| 4,673,800 | A | 6/1987 | Hirai et al. | |
| 4,697,580 | A | 10/1987 | Terauchi | |
| 4,748,755 | A * | 6/1988 | Bain et al. | 38/88 |
| 4,821,631 | A | 4/1989 | Wong et al. | |
| 5,079,405 | A | 1/1992 | Pierce | |
| 5,094,021 | A | 3/1992 | Chen | |
| 5,787,614 | A | 8/1998 | Stutzer | |
| 5,798,588 | A | 8/1998 | Okuyama et al. | |
| 5,848,980 | A | 12/1998 | Demerais | |
| 6,035,563 | A | 3/2000 | Hoefer et al. | |
| 6,081,055 | A | 6/2000 | Narusawa | |
| 6,427,583 | B1 | 8/2002 | Shimansky et al. | |
| 6,785,989 | B2 * | 9/2004 | Rienzo et al. | 38/77.1 |
| 6,857,209 | B2 | 2/2005 | Wehrwein et al. | |
| 6,927,366 | B2 | 8/2005 | Sawhney et al. | |
| 7,129,607 | B2 | 10/2006 | Segawa | |
| 2004/0154474 | A1 | 8/2004 | Chan | |
| 2008/0209773 | A1 * | 9/2008 | Akhter | 38/75 |

FOREIGN PATENT DOCUMENTS

| | | | |
|---|---|---|---|
| DE | 4026378 | A1 | 9/1991 |
| JP | 11-253309 | A | 9/1999 |
| JP | 2006094924 | A | 4/2006 |

* cited by examiner

*Primary Examiner* — Ismael Izaguirre
(74) *Attorney, Agent, or Firm* — Baker & Daniels LLP

(57) ABSTRACT

Devices and methods for applying vibrations to the iron sole of an ironing appliance to facilitate the movement of the iron sole over a fabric, thereby improving the effectiveness of the ironing appliance in removing wrinkles, especially on thicker fabrics.

10 Claims, 10 Drawing Sheets

| | |
|---|---|
| R-Square | 0.612168 |
| Sum of Squares Error | 0.112471 |

| | |
|---|---|
| R-Square | 0.469499 |
| Sum of Squares Error | 0.153845 |

DEVICES AND METHODS OF FACILITATING COOKING AND IRONING USING VIBRATION PULSES

CROSS REFERENCE TO RELATED APPLICATIONS

This application claims the benefit under Title 35 U.S.C. §119(e) of U.S. Provisional Patent Application Ser. No. 60/977,856, entitled DEVICES AND METHODS OF FACILITATING COOKING AND IRONING USING VIBRATION PULSES, filed on Oct. 5, 2007, the entire disclosure of which is hereby incorporated herein by reference.

BACKGROUND OF THE INVENTION

1. Field of the Invention

The present invention relates to the fields of cooking foods and ironing fabrics and, in particular, relates to the use of vibration pulses to facilitate cooking and ironing.

2. Description of the Related Art

In the use of appliances such as griddles, rice cookers, etc., for cooking, as well as the use of cookware such as pans, skillets, etc., the sticking of foodstuffs to the cooking surfaces these items has long been a known problem, as same increases the difficulty of cooking multiple food items and/or cleaning these items. The use of non-stick coatings, which typically include a fluoropolymer that provides a non-stick property, is well known to reduce sticking of foodstuffs to the cooking surfaces.

In the ironing of fabrics, wrinkles are removed by the use of heat to loosen the bonds between the long-chain polymer molecules in the fibers of the fabric. When the molecules are heated, the fibers may be straightened by the weight of the heated sole of the iron, and the fibers thereafter tend to hold their smoothed or flattened shape as they cool. Some fabrics, such as cotton, may require the addition of water, which is typically sprayed from an ironing appliance by a spray pump device, to loosen the intermolecular bonds of the fibers. Some ironing appliances also eject steam through the fabric during the ironing process to aid in loosening the bonds between the molecules in the fibers of the fabric.

When ironing appliances are used for ironing items of clothing and/or other fabrics, it is desirable to prevent sticking of the fabrics to the hot surface of the iron sole and to facilitate smooth movement of the heated iron sole over the fabric.

What is needed are improvements in the fields of cooking and ironing to address the foregoing concerns.

SUMMARY OF THE INVENTION

The present invention relates to devices and methods for applying vibrations to cooking surfaces to prevent sticking of foodstuffs to the cooking surfaces and to facilitate improved cooking, such as by producing an aeration and/or spreading effect. The present invention also relates to devices and methods for applying vibrations to the iron sole of an ironing appliance to facilitate the movement of the iron sole over a fabric, thereby improving the effectiveness of the ironing appliance in removing wrinkles, especially on relatively thicker fabrics.

In one form thereof, the present invention provides a method of cooking, including the steps of providing a planar, horizontally disposed cooking surface; heating the cooking surface; and applying vibrations directly to the cooking surface; and cooking a food on the cooking surface during said applying vibrations step.

In another form thereof, the present invention provides a cooking device, including a planar, horizontally disposed cooking surface; and a vibration device directly coupled to the cooking surface and operable to apply vibrations directly to the cooking surface.

In a further form thereof, the present invention provides an ironing appliance, including a body including a handle and an iron sole; a vibration device coupled to the iron sole, the vibration device movable through a range of orientations that are displaced with respect to a vertical position in which the vibration device transmits vibrations to the iron sole within a vertical plane; and a user-operable switch associated with the handle, the switch actuable to move the vibration device through the range of orientations.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention any manner.

DETAILED DESCRIPTION

The present invention relates to devices and methods for applying vibrations to cooking surfaces to prevent sticking of foodstuffs to the cooking surfaces and to facilitate improved cooking, such as by producing an aeration and/or spreading effect. The present invention also relates to devices and methods for applying vibrations to the iron sole of an ironing appliance to facilitate the movement of the iron sole over a fabric, thereby improving the effectiveness of the ironing appliance in removing wrinkles, especially on relatively thicker fabrics.

Vibrations may be directly or indirectly applied or transmitted to a cooking surface or to an iron sole by mechanical oscillation by coupling a vibrating device such as an electric motor or rotary tool with an unbalanced mass on its drive shaft, for example, to the cooking surface or iron sole by a mechanical connection, or otherwise incorporating a vibrating device within a cooking or ironing appliance.

By use of phrases herein such as "vibrations directly applied to", or "applying vibrations directly to", or "a vibration device directly coupled to", and the like, it is meant that there is a mechanical connection or abutment between the vibration device and the surface that is in contact with the substrate, such as a cooking surface or an iron sole, for example, wherein the vibrational frequency generated by the vibration device is equal to, or substantially equal to, the vibrational frequency of the vibrations experienced by, or transmitted to, the surface in contact with the substrate.

In one embodiment, the frequency of the vibrations that are generated by the vibration device, and which are transmitted to the surface in contact with the substrate, may be as little as 1,000 rpm, 1,500 rpm, or 2,000 rpm, or may be as great as 5,000 rpm, 5,500 rpm, 6,000 rpm or greater.

1. Cooking Application.

The present invention, in a first form thereof, relates to devices and methods for applying vibrations to cooking surfaces to prevent sticking of foodstuffs to the cooking surfaces and/or to facilitate improved cooking, such as by producing an aeration and/or spreading effect.

For cooking and cookware, applying vibrations to, or vibrating, the cooking surface has been found to:

(1) reduce the propensity of foodstuffs to stick to the cooking surface, especially for small and/or chopped foodstuffs;

(2) promote more even cooking of the foodstuffs as evidenced by the uniformity of browning produced;

(3) cause fluid foodstuffs to spread more thinly and to produce aeration, for example, in pancakes; and (4) reduce the required frequency of manual intervention by the cook to ensure even cooking and avoidance of sticking.

COOKING EXAMPLES

The following non-limiting Examples illustrate various features and characteristics of the cooking application of present invention, which is not to be construed as limited thereto.

Example 1

Application of Vibration to Cooking

Figure 1A:
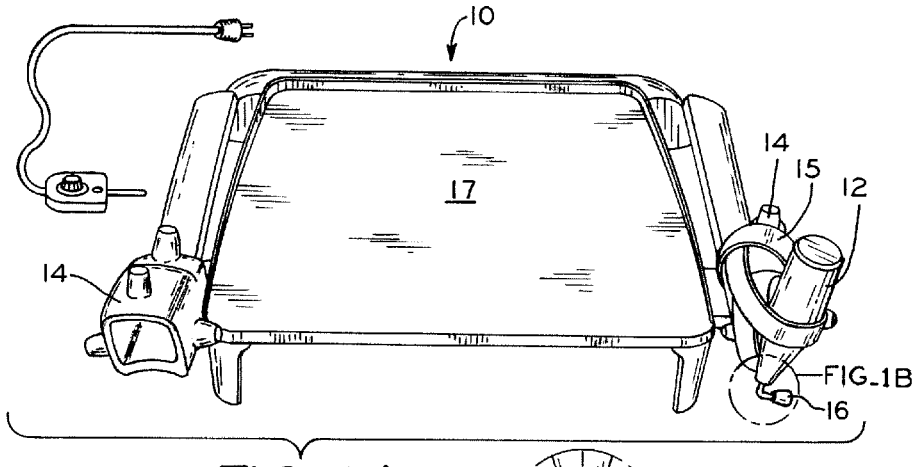
FIG. 1A is a view of a griddle with a vibration device mounted thereto, the vibration device configured to produce vibrations in a horizontal plane.
Figure 1B:
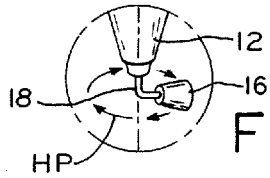
FIG. 1B is an enlarged fragmentary view of a portion of FIG. 1A.
Figure 2A:
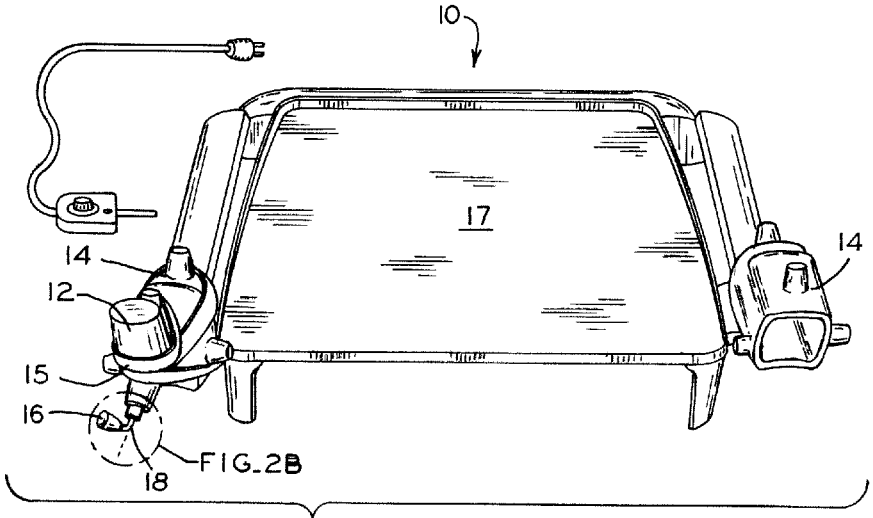
FIG. 2A is a view of the griddle of FIG. 1A with a vibration device mounted thereto, the vibration device configured to produce vibrations in a vertical plane.
Figure 2B:
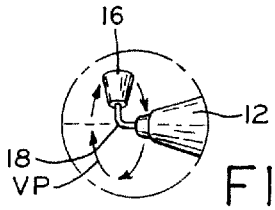
FIG. 2B is an enlarged fragmentary view of a portion of FIG. 2A.

Vibration in cooking was investigated by applying varying degrees of vibration to the cooking surface of an electric griddle 10, shown in FIGS. 1A and 2A. Electric griddle 10 was of the type commercially available from many sources. The vibrating device used was an electric rotary tool 12, specifically, a Dremel® cordless rotary tool, available from Robert Bosch Tool Corporation. (Dremel® is a registered trademark of Credo Technology Corporation). Tool 12 was mounted to a leg of griddle 10 by means of a molded fixture 14 made from a commercially available two-part epoxy molding compound. Fixture 14 and tool 12 were firmly and rigidly secured to the leg of griddle 10 using a Velcro™ strap 15, such that vibrations from tool 12 were directly transferred, via the abutment of tool 12 with fixture 14, and thence via the abutment of fixture 14 to griddle 10, to the horizontal, planar cooking surface 17 of griddle 10. With further reference to FIGS. 1B and 2B, a commercially available lead fishing weight 16 was mounted to a shaft 18 held in the chuck of tool 12 such that the major axis of weight 16 was perpendicular to shaft 18. Weights 16 having ⅛, ⅙, ¼, ⅜ and 1 oz. nominal sizes were used, and the actual measured mass of same is set forth in grams in Table 1 below.

A number of different foodstuffs were cooked in parallel on non-modified control griddles and on the modified griddle 10, with the latter being vibrated under different conditions using tool 12. The speed setting of tool 12, the size/mass of weight 16, and the orientation of tool 12 in either a horizontal plane "HP" (FIG. 1B) or a vertical plane "VP" (FIG. 2B) were all varied during the course of the trials.

The speed setting on the dial of tool 12, the rpm of tool 12 as reported in the product literature of tool 12, the size/mass of weights 16, and the actual rpm of tool 12 with weights 16 are set forth in Table 1 below. The actual rpm of tool 12 ranged from about 1000 to 5300. All of the settings below were performed using the orientation of tool 12 in both a horizontal plane "HP" (FIG. 1B) and a vertical plane "VP" (FIG. 2B).

TABLE 1

| | | Weight nominal size (#) (oz.) | | | |
|---|---|---|---|---|---|
| | | 1 | ⅜ | ¼ | ⅙ |
| | | Weight mass (g) | | | |
| | | 27.05 | 10.25 | 7.12 | 5.2 |
| Tool setting | Literature rpm of tool | Actual rpm w/weight | Actual rpm w/weight | Actual rpm w/weight | Actual rpm w/weight |
| (lowest) | — | 1020 | 1800 | 2100 | 2460 |
| 2 | 5,000-10,000 | 1140 | 1980 | 2640 | 2880 |
| 4 | 10,000-14,000 | 1260 | 2340 | 3120 | 3480 |
| 6 | 14,000-18,000 | 1500 | 2820 | 3540 | 4140 |
| 8 | 18,000-22,000 | 1620 | 3180 | 4320 | 4860 |
| 10 | 22,000-25,000 | (not meas.) | (not meas.) | (not meas.) | 5220 |

In general, all of the variables described above produced some beneficial effects, as discussed below. However, optimum performance appeared to be achieved using the ⅜ size for weight 16 and a horizontal plane of vibration for tool 12 (FIG. 1).

The following summarizes the findings for various foodstuffs:

Bacon, eggs and burgers: These items, once initially sealed by the heat, moved freely and continuously around the cooking surface of griddle 10. There was some indication that these items cooked more evenly as judged by the evenness of browning on their heat exposed undersides.

Chopped tomatoes, mushrooms and onions: As well as moving continuously, these items had a tendency to spread and in some cases 'dance' on the surface of griddle 10, preventing burning on one side or the other.

Figure 3:
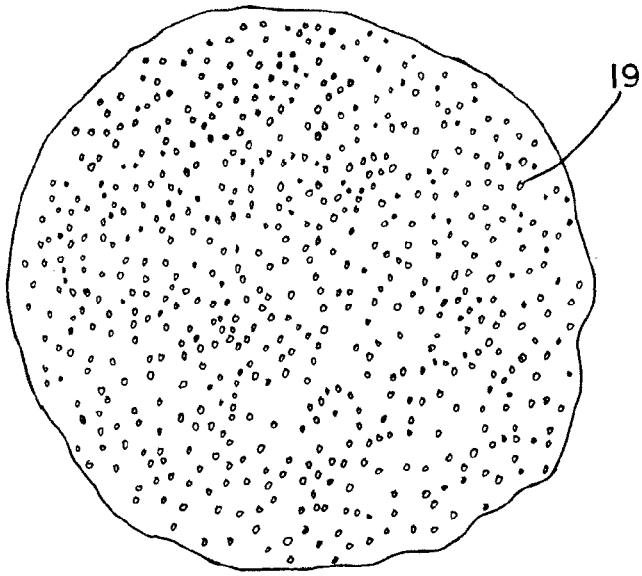
FIG. 3 is a view of a pancake that was cooked on the griddle of FIG. 1 while vibrations were applied to the griddle.
Figure 4:
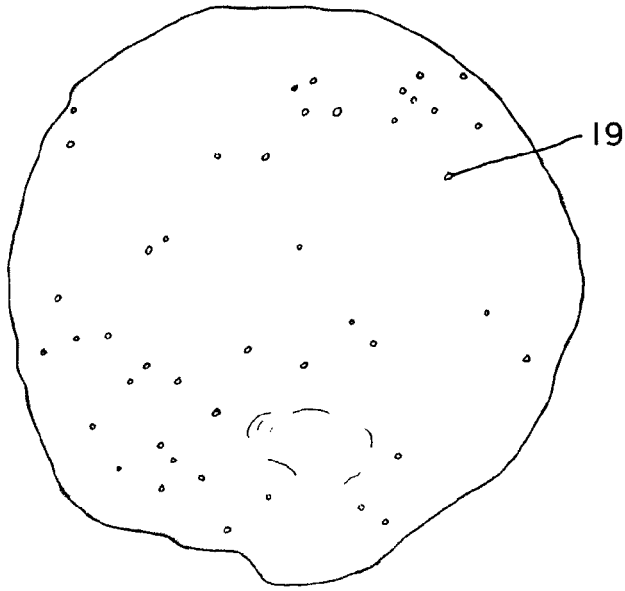
FIG. 4 is a view of a pancake that was cooked on a control griddle without the use of vibrations.

Pancakes and omelets: In both cases omelets and pancake mixture had a tendency to spread on the cooking surface which facilitated cooking speed. They also moved freely on the cooking surface but in addition exhibited another phenomenon, namely, aeration. Tiny bubbles formed in both cases and were frozen in place as the respective mixture thickened during cooking. This was particularly noticeable for the pancake mixture, which produced a thin aerated pancake, shown in FIG. 3, having numerous pores 19 due to the formation of air bubbles, which readily held and absorbed maple syrup, as compared with the pancake shown in FIG. 4, having much fewer pores 19 that was cooked with the control griddle without application of vibration.

Example 2

Measurements of Size of Pancakes Cooked with and without Applied Vibration

Pancakes were cooked with and without applied vibration using griddle 10 of Example 1 above, with a tool setting of 6, using the ¼ oz. (7.12 g) weight and producing 3540 actual tool rpm, with horizontal vibration. As far as was reasonably possible the same wet weight of pancake mixture was used in each case. Measurements were made on the pancakes following cooking and dimensional differences were measured. The diameters of the cooked pancakes were measured in 5 locations, and thereafter, the thicknesses of the cooked pancakes were measured in 10 locations using enlarged photographs of the pancakes when cut in half, for greater measurement accuracy.

TABLE 2

Pancake diameter.

| Diameter (cm) (vibration applied) | Diameter (cm) (no vibration applied) |
|---|---|
| 12.6 | 11.8 |
| 12.6 | 12 |
| 12.6 | 12 |
| 12.4 | 11.9 |
| 12.4 | 11.9 |
| Average - 12.52 | Average - 11.92 |

TABLE 3

Pancake thickness.

| Thickness (cm) (vibration applied) | Thickness (cm) (no vibration applied) |
|---|---|
| 2.9 | 2.8 |
| 3.1 | 3.1 |
| 3.2 | 3.3 |
| 3.5 | 3.2 |
| 3.6 | 2.6 |
| 3.2 | 2.4 |
| 3.4 | 3.2 |
| 3.3 | 3.3 |
| 3.2 | 3 |
| 2.9 | 2.6 |
| Average - 3.23 | Average - 2.95 |

Although there was a small difference in the wet weight of the pancakes the cooked weights were identical. Further results, including pancake bulk density, are shown in Table 4 below:

TABLE 4

Pancake comparison.

| | Vibration applied | No vibration applied |
|---|---|---|
| Wet weight (g) | 76 | 79 |
| Cooked weight (g) | 70 | 70 |
| Diameter (cm, average from Table 2) | 12.52 | 11.92 |
| Thickness (cm, average from Table 3) | 3.23 | 2.95 |
| Volume ($cm^3$) | 398 | 329 |
| Relative volume | 121% | 100% |
| Relative bulk density | 83% | 100% |

For both the diameter and thickness of the pancakes the vibrated pancake was larger for the same cooked weight, i.e., its cooked volume was 121% of the unvibrated pancake and hence its bulk density was only 83% of the unvibrated pancake. It is expected that pancakes that are cooked using vibration according to the present invention will have a bulk density that is at least 10% less than the bulk density of pancakes that are not cooked using such vibration. This reduction in bulk density was due to increased aeration, which is a result of the vibrations inducing formation of more and larger air bubbles within the pancake batter during cooking. The differences in diameter and thickness were statistically significant as shown by ANOVA studies.

In an alternative embodiment, tool 12 could be directly coupled to the cooking surface of griddle 10 such as described above, and the cooking surface of griddle 10 could be isolated from the rest of griddle 10 by a silicone rubber gasket, for example, to eliminate transmission of vibration beyond the cooking surface. In this alternative configuration, it is anticipated that a significantly reduced energy of vibration may achieve the desired effects discussed above.

2. Ironing Application.

The present invention, in another form thereof, also relates to devices and methods for applying vibrations to the iron sole of an ironing appliance to facilitate the movement of the iron sole over a fabric, thereby improving the effectiveness of the ironing appliance in removing wrinkles, especially from relatively thicker fabrics.

For ironing, applying vibrations to, or vibrating, the iron sole of an ironing appliance has been found to:

(1) reduce the force required to move the iron sole over a fabric;

(2) increase the smoothing power of the iron sole versus the case where no vibrations are employed, in particular, it has been observed that using vibrations is more effective in smoothing relatively thicker fabrics or double layered fabrics such as trouser legs; and (3) permit less heat to be applied to the fabric in order to smooth and remove wrinkles

IRONING EXAMPLES

The following non-limiting Examples illustrate various features and characteristics of the ironing application of the present invention, which is not to be construed as limited thereto.

Example 3

Application of Vibration to Ironing

Figure 5A:
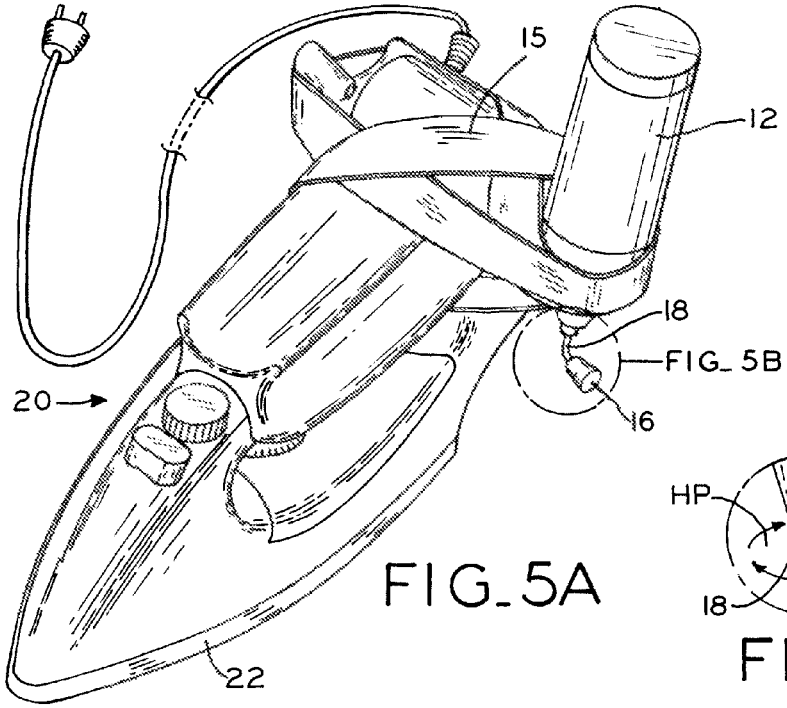
FIG. 5A is a view of an iron with a vibration device mounted thereto, the vibration device configured to produce vibrations in a horizontal plane.
Figure 5B:
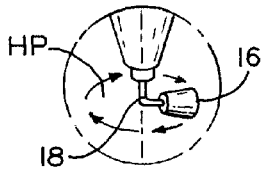
FIG. 5B is an enlarged fragmentary view of a portion of FIG. 5A.
Figure 6A:
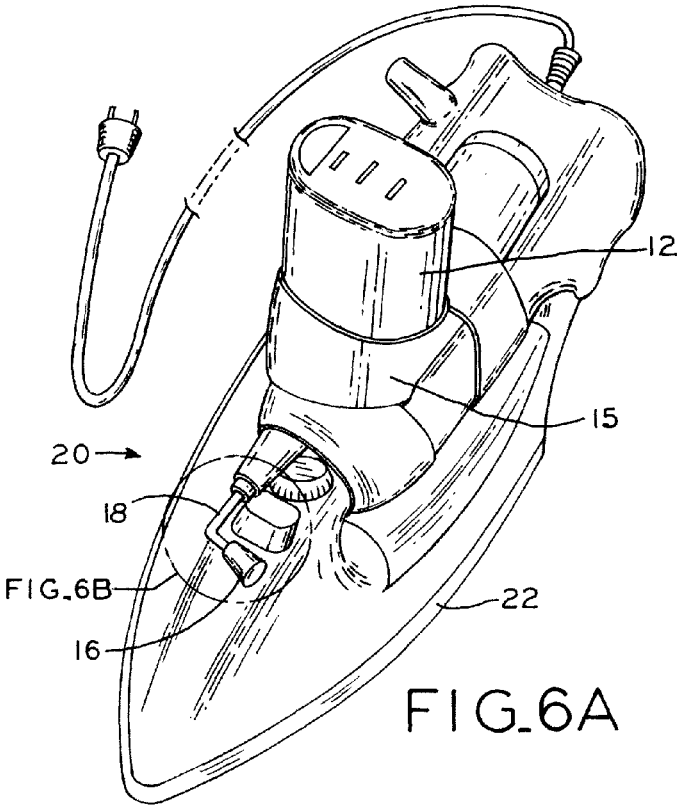
FIG. 6A is a view of the iron of FIG. 5A with a vibration device mounted thereto, the vibration device configured to produce vibrations in a vertical plane.
Figure 6B:
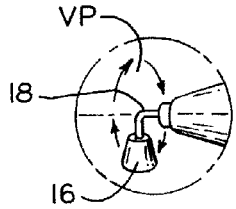
FIG. 6B is an enlarged fragmentary view of a portion of FIG. 6A.

In this embodiment, referring to FIGS. 5A and 6A, two identical commercially available electrical steam irons 20 were employed. One iron 20 was modified by mounting a vibrating tool 12 to the iron in the same manner as described above with respect to griddle 10 in Example 1. In the present example, some beneficial effects were found for all configurations of speed of tool 12, size of weight 16, and vibration orientation of tool 12 in either a horizontal plane "HP" (FIG. 5B) or a vertical plane "VP" (FIG. 6B). However, optimum performance appeared to be achieved using heavier weights 16 of ⅜ and 1 size with speeds of tool 12 between 4 and 8 on the dial of tool 12 with vibration in a vertical plane, as opposed to vibration in a horizontal plane for the cooking application of Example 1 above.

A number of fabric items were ironed using the modified iron 20 with tool 12 turned on and off. For most cases only the modified iron was used so as to eliminate any confounding of the results due simply to the increase weight of the iron as a result of mounting tool 12.

Observations on performance were as follows:

1. With vibration iron 20 was much easier to move over the fabric and also reduced 'scuffing' or wrinkling of the fabric due to friction of the sole plate 22 of iron 20 on the fabric surface.

2. There was some indication that heat could be reduced when employing vibration.

3. Relatively thicker fabrics were much more effectively ironed with vibration than without even with steam applied. For example, toweling fabrics were clearly more compacted during ironing with vibration. Similarly, when ironing trouser legs both sides were more effectively ironed when ironing was done from one side only with vibration than without.

Referring to FIGS. 7A-D and 9, creases were ironed along single folds of pieces of canvas fabric using iron 20 with tool 12 producing vibrations according to the parameters in Table 5 below:

TABLE 5

| Trial | Tool setting | Weight size, weight (g), and radius (cm) | Actual tool rpm | Energy dissipated (watts) | Rating of creases | Thickness of ironed fabric (cm) |
|---|---|---|---|---|---|---|
| 1 | 0.1 | 1(27.05 g)(2.5) | 1020 | 0.096 | | |
| 2 | 2 | 1(27.05 g)(2.5) | 1140 | 0.120 | 2 | 1.3 |
| 3 | 4 | 1(27.05 g)(2.5) | 1260 | 0.147 | 3 | 1.3 |
| 4 | 6 | 1(27.05 g)(2.5) | 1500 | 0.209 | 4 (FIG. 7A) | 1.2 |
| 5 | 8 | 1(27.05 g)(2.5) | 1620 | 0.243 | 5 | 1 |
| 6 | 0.1 | 3/8(10.25 g) (2) | 1800 | 0.073 | | |
| 7 | 2 | 3/8(10.25 g) (2) | 1980 | 0.088 | 3 | 1.3 |
| 8 | 4 | 3/8(10.25 g) (2) | 2340 | 0.123 | 4 | 1.1 |
| 9 | 6 | 3/8(10.25 g) (2) | 2820 | 0.179 | 4.5 | 1.2 |
| 10 | 8 | 3/8(10.25 g) (2) | 3180 | 0.227 | 5 (FIG. 7B) | 1 |
| 11 | 0.1 | 1/4(7.12 g)(1.75) | 2100 | 0.053 | | |
| 12 | 2 | 1/4(7.12 g)(1.75) | 2640 | 0.083 | 3 | 1.2 |
| 13 | 4 | 1/4(7.12 g)(1.75) | 3120 | 0.116 | 3 | 1.1 |
| 14 | 6 | 1/4(7.12 g)(1.75) | 3540 | 0.150 | 5 | 1 |
| 15 | 8 | 1/4(7.12 g)(1.75) | 4320 | 0.223 | 5 | 1.1 |
| 16 | 0.1 | 1/6(5.2 g)(1.5) | 2460 | 0.039 | | |
| 17 | 2 | 1/6(5.2 g)(1.5) | 2880 | 0.053 | | |
| 18 | 4 | 1/6(5.2 g)(1.5) | 3480 | 0.078 | 2.5 | 1.1 |
| 19 | 6 | 1/6(5.2 g)(1.5) | 4140 | 0.110 | | |
| 20 | 8 | 1/6(5.2 g)(1.5) | 4860 | 0.152 | 4 | 1.1 |
| 21 | 10 | 1/6(5.2 g)(1.5) | 5220 | 0.175 | 3 (FIG. 7C) | |
| 22 | — | 1(27.05 g)(2.5) | | 0 | | |
| 23 | — | 1(27.05 g)(2.5) | | 0 | | |
| 24 | — | 1(27.05 g)(2.5) | | 0 | | |
| 25 | — | 1(27.05 g)(2.5) | | 0 | | |
| 26 | — | 1(27.05 g)(2.5) | — | 0 | 1 (FIG. 7D) | 1.5 |
| 27 | — | 1(27.05 g)(2.5) | | 0 | | |
| 28 | — | (Shaft only)(3.18g) | | 0 | | |

Figure 9:
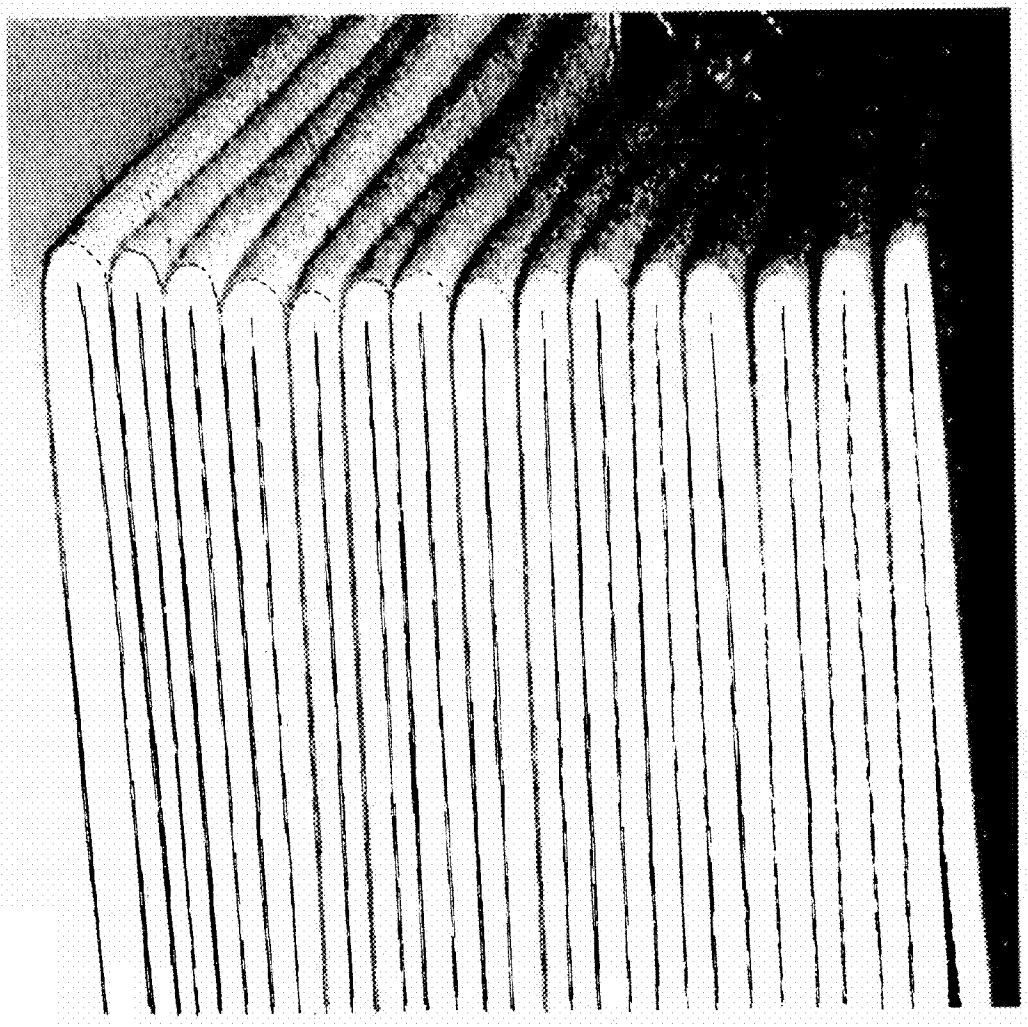
FIG. 9 is a view of the single-folded ironed canvas fabric pieces of certain trials of the ironing test of Example 3.

The thickness of the ironed fabric pieces were measured at locations 1 cm inward from each ironed fold line, and the folded fabrics are shown stacked, after measuring, in FIG. 9 from the thickest piece at the bottom to the thinnest piece at the top. The creases produced in the fabric pieces were rated qualitatively based on sharpness on a scale of 1 to 5.

Figure 7A:
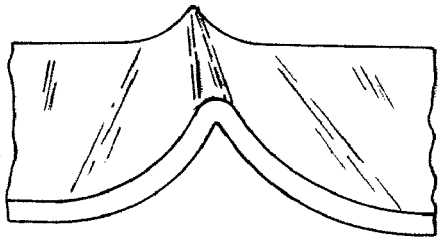
FIGS. 7A-D are views of creases in towels which were obtained by ironing pieces of folded canvas fabric under varying conditions.
Figure 7B:
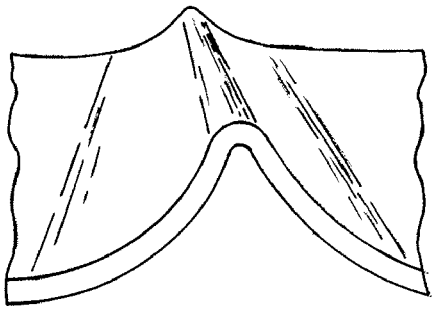
Figure 7C:
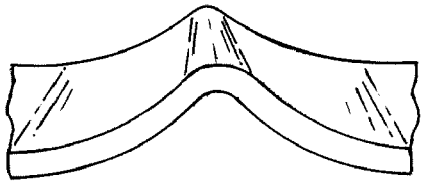
Figure 7D:
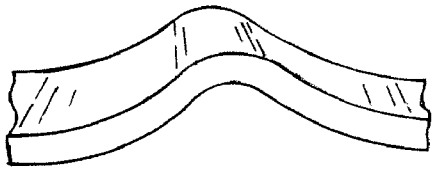

As will be apparent from FIGS. 7A-D and 9, sharper creases in the fabric pieces were clearly obtained when vibration was applied (FIGS. 7A-C) versus the control trial with no vibration (FIG. 7D). The sharpest crease was obtained with a vibration of 2800 rpm using the 10.25 g weight (FIG. 7B).

As a first approximation, the dissipated energy (E) per unit time was assumed to be directly proportional to the kinetic energy (KE) of the rotating weight $$KE=(\text{mass of weight}/2000)*(\text{radius}*2\pi*\text{rpm}/6000)\hat{}2 \text{ joules}$$

$$E=k*KE \text{ (watts)}$$

Wherein: "mass" is the mass of the weight in Kg; "radius" is the distance from the center of mass of the weight to the axis of rotation in meters; and k=constant.

Figure 8A:
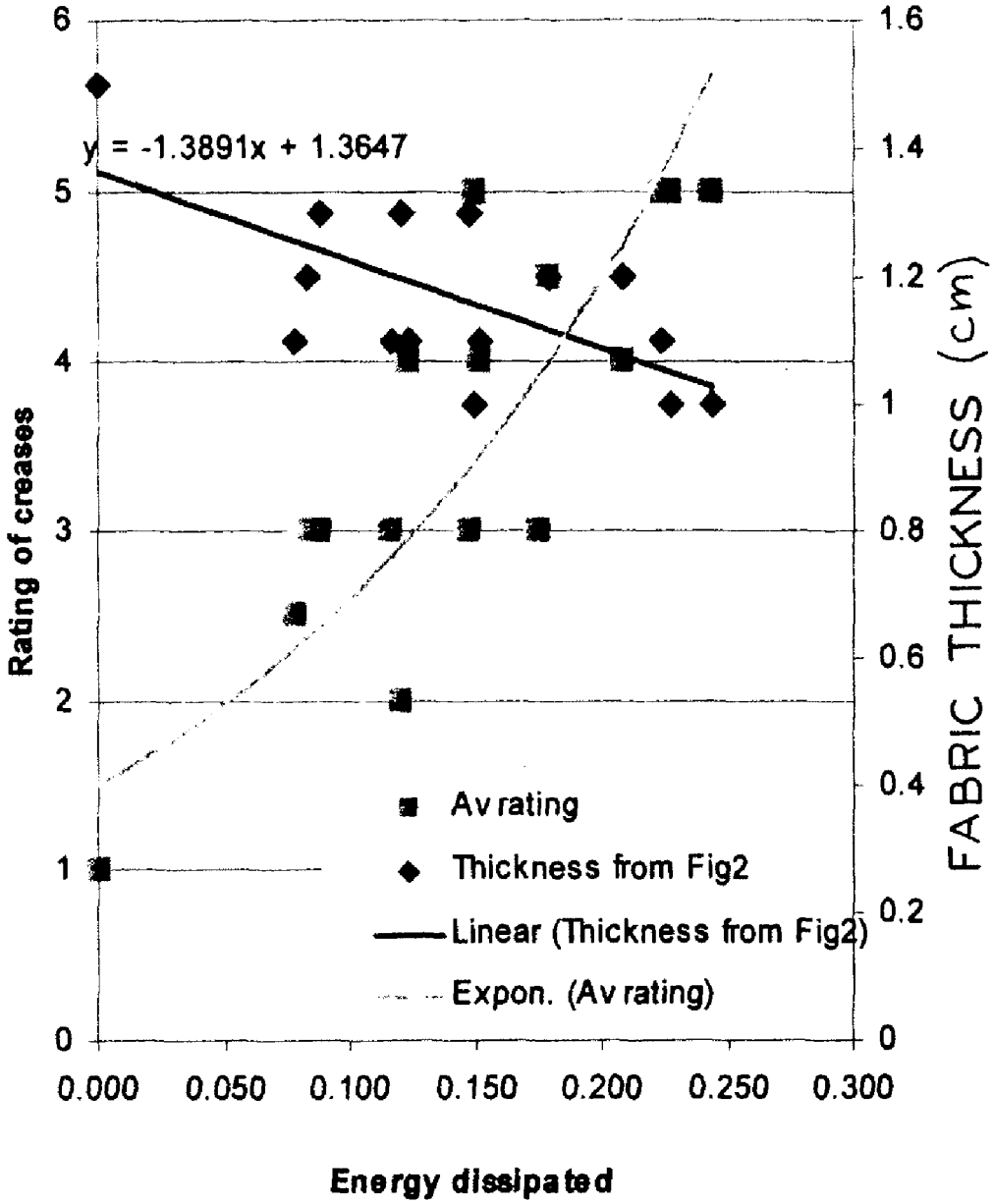
FIG. 8A is a chart showing energy dissipated vs. rated creases (left column) and measured thicknesses (right column) of certain trials of the ironing test of Example 3.
Figure 8B:
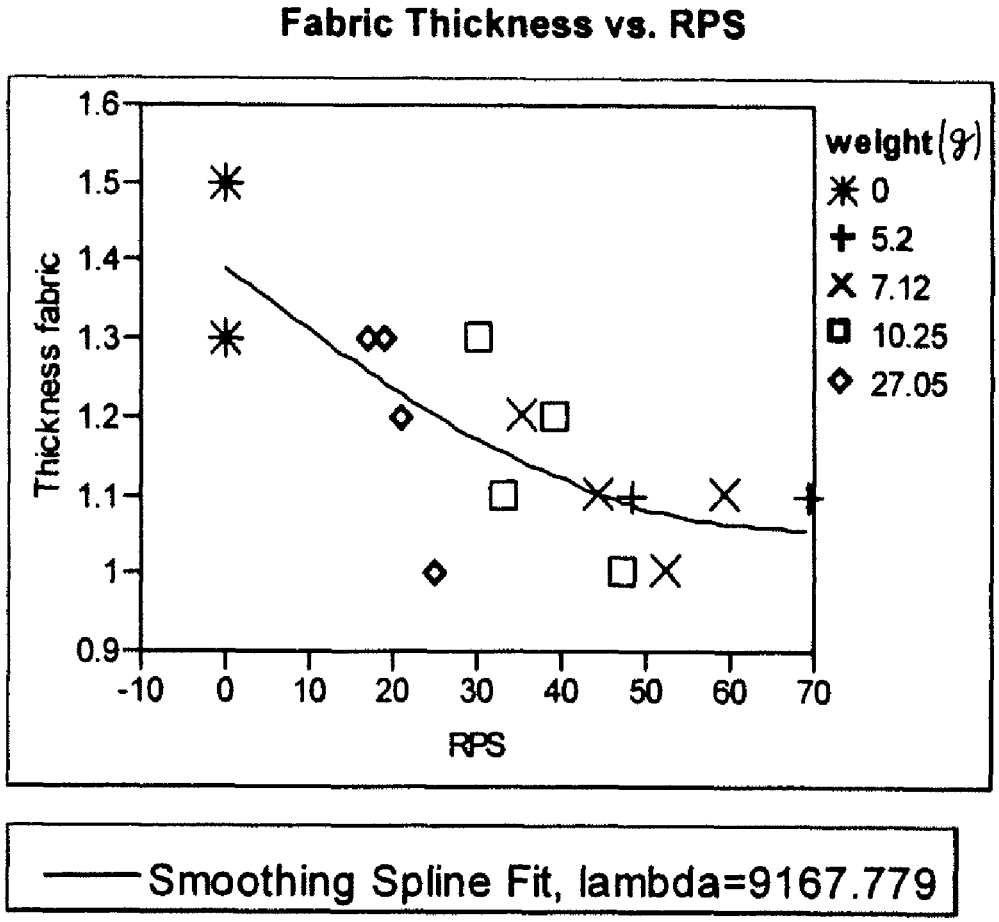
FIG. 8B is a chart showing fabric thickness vs. revolutions per second of certain trials of the ironing test of Example 3.
Figure 8C:
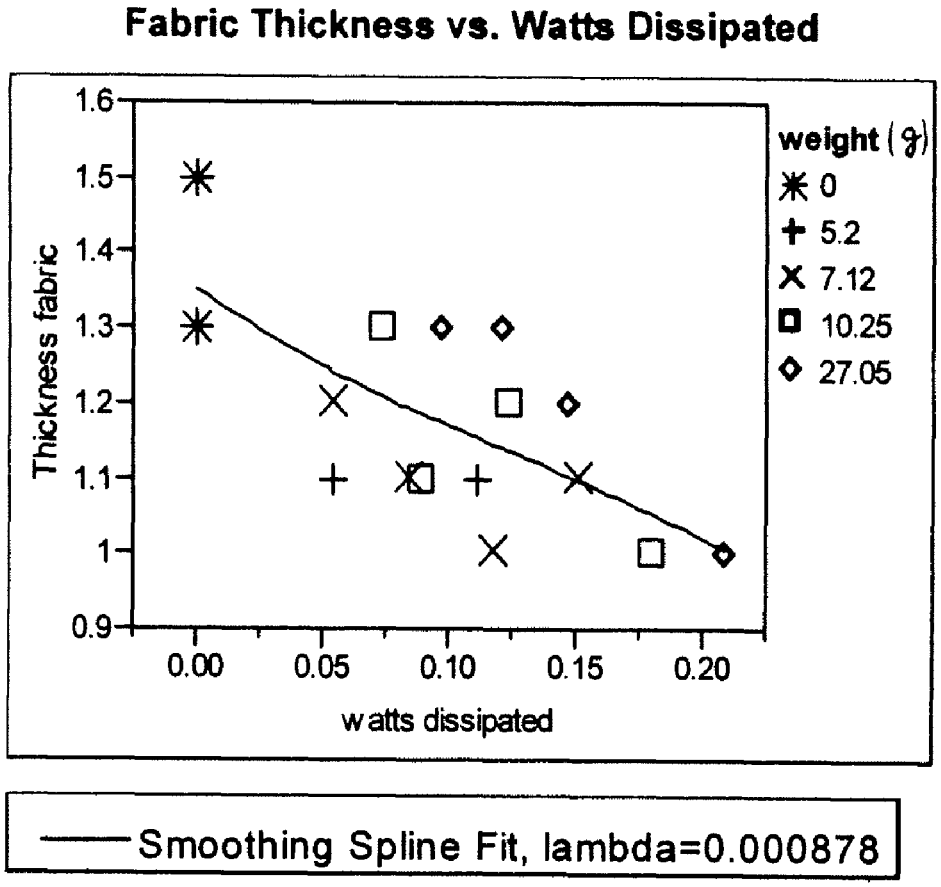
FIG. 8C is a chart showing fabric thickness vs. watts dissipated of certain trials of the ironing test of Example 3.

A chart showing the energy dissipated vs. the rated creases and the measured thicknesses of the above trials is set forth in FIG. 8A. Also, as shown in FIGS. 8B and 8C, the thickness of the folded fabric pieces tends to decrease with greater revolutions per second (FIG. 8B) and, in an analogous manner, the thickness of the folded fabric pieces tends to decrease with greater watts dissipated (FIG. 8C).

In another experiment, two pieces of fabric were folded four times and then ironed along the fold line, one piece with vibrations and the other without. The thickness of each piece was then measured at multiple locations near the fold line.

Figure 10:
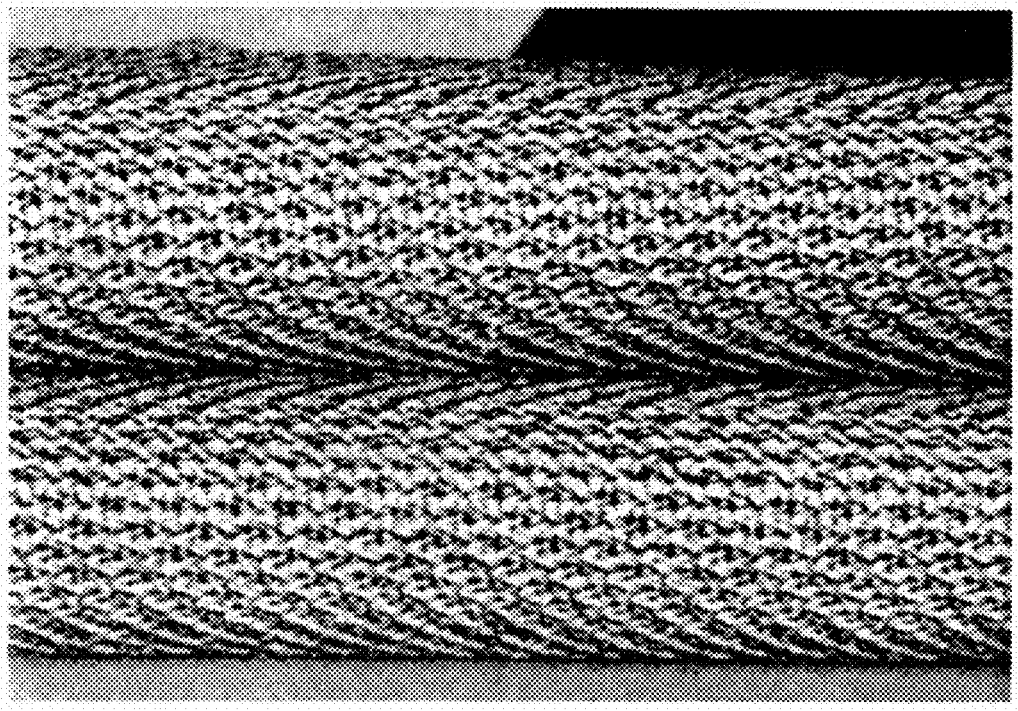
FIG. 10 is a view of four-folded ironed fabric pieces in accordance with Example 3.

The folded pieces, after ironing, are shown in FIG. 10, with the piece ironed with vibrations on the top. The data is set forth in Table 6 below:

TABLE 6

| Measurement # | Height (no vibrations) (mm) | Height (with vibrations) (mm) |
|---|---|---|
| 1 | 58 | 52 |
| 2 | 59 | 51 |
| 3 | 58 | 50 |
| 4 | 57 | 50 |
| 5 | 56 | 50 |
| 6 | 57 | 49 |
| Average | 57.5 | 50.3 |
| % | 100 | 88 |

As will be apparent, ironing with vibration yielded greater compaction of the fabric, wherein the fabric ironed with vibrations was on average 88% of the thickness of the fabric ironed without vibrations.

In similar manner to the cooking application described above in Example 1, it is anticipated that if the vibrator device where coupled directly to sole plate 22 of iron 20 and isolated from the rest of iron 20, further improvements in performance would ensue.

Figure 11:
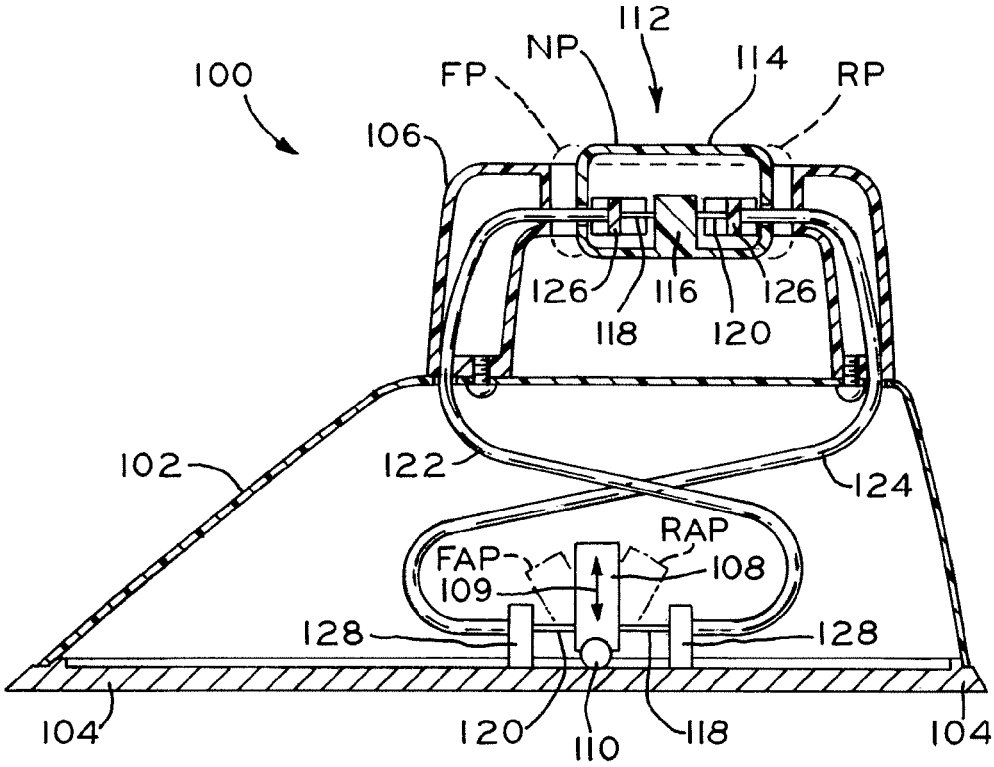
FIG. 11 is a schematic view of an iron having a vibration device and a handle-actuated switch that varies the orientation of the vibration device.

Referring to FIG. 11, one embodiment of an iron including a vibration device according to the present invention is shown. Iron 100 generally includes a body 102 which may be made of a rigid plastic material, for example, and sole plate 104 attached to body and made of a suitable heat conductive metal. Handle 106 is generally U-shaped, and extends from the top of body 102 for grasping by an operator to operate and move iron 100.

Iron 100 includes vibration device 108, which may be in the form of an electric motor-driven oscillator, for example, which is disposed within body 102 and is connected directly to sole plate 102 via a hinge connection 110, which may be a ball hinge, piano hinge or other suitable mechanical hinge connection, for example, and which transmits vibrations from vibration device 108 directly to sole plate 102. Vibration device 108 vibrates within a vertical plane, illustrated by arrow 109 in FIG. 11, to transfer vibrations directly through hinge connection 110 to sole plate 102 of iron 100. Handle 106 includes a switch 112 including slide member 114 slidably attached to handle 106 for slidable movement from a neutral position "NP", shown in solid lines in FIG. 11, to either a forward position "FP" or a rearward position "RP", each shown in dashed lines in FIG. 11, as discussed below.

Slide member 114 of switch 112 includes attachment point 116 for a pair of push/pull cables 118 and 120 which include first ends respectively attached to opposite sides of attachment point 116 of slide member 114, and second ends respectively attached to opposite ends of vibration device 108. A pair of sheaths or sleeves 122 and 124 cover cables 118 and 120, respectively, and include first and second ends attached to upper attachment points 126, which are fixed on handle 106, and lower attachment points 128 attached on the lower end of body 102 or sole plate 102, respectively, such that push-pull cables 118 and 120 are slidable within sleeves 122 and 124.

In use, sole plate 102 is heated via a suitable electrical heating device (not shown) and vibration device 108 is powered to apply vibrations within a generally vertical plane when slide member 114 of switch 112 is disposed in the neutral position "NP" shown in solid lines in FIG. 11. In the neutral position, vibration device 108 will apply vibrations in a vertical plane to the substrate which is ironed, which will tend to compact the substrate as described above.

When the operator grasps slide member 114 of switch 112 and pushes iron 100 forward, slide member 114 will shift with respect to handle 106 to the forward position "FP", shown in dashed lines in FIG. 11, thereby pushing cable 118 and pulling cable 120 to shift or pivot vibration device 108 about hinge connection 110 to a forwardly angled position "FAP" with respect to vertical, as shown by dashed lines in FIG. 11. The forwardly angled position of vibration device 108 is directly proportional to the extent of shifting of slide member 114 of switch 112, such that vibration device 108 may be shifted from a vertical position up to 45° from vertical on maximum sliding displacement of slide member 114, or any angle therebetween depending upon the extent of displacement of slide member 114. Switch 112 may optionally include a biasing device (not shown), such as a spring or pair of springs, which bias slide member 114 to the neutral position "NP" and which may provide an increasing resistance to displacement of slide member 114 which is proportional to the extent of displacement of slide member 114 from neutral position "NP".

Similarly, when the operator grasps slide member 114 of switch 112 and pushes iron 100 rearward, slide member 114 will shift with respect to handle 106 to the rearward position "RP", shown in dashed lines in FIG. 11, thereby pulling cable 118 and pushing cable 120 to shift or pivot vibration device 108 about hinge connection 110 to a rearwardly angled position "RAP" with respect to vertical, as shown in dashed lines in FIG. 11. The rearwardly angled position of vibration device 108 is directly proportional to the extent of shifting of slide member 114 of switch 112, such that vibration device 108 may be shifted from a vertical position up to 45° from vertical on maximum sliding displacement of slide member 114, or any angle therebetween depending upon the extent of displacement of slide member 114.

The shifting of vibration device 108 from its vertical position will apply vibrations to sole plate 102 at the angle in which vibration device 108 is disposed. To the extend that the vibrations produced by vibration device have a vertical component of direction, same will compact the substrate which is ironed. Also, to the extent that the vibrations produced by vibration device have a horizontal component of direction, same will apply a force vector that will tend to drive iron in a forward direction. These two components of direction will operate to both compact the substrate and to drive iron 100 forward, depending proportionately on the extent to which slide member 114 is moved. For example, if slide member 114 is displaced to a relatively great extent, the horizontal force vector will increase relative to the vertical force vector to thereby drive iron 100 forward to a greater extent while the vertical force vector associated with the vibrations will decrease, tending to compact the substrate less, and vice-versa.

In this manner, the actuation of slide member 114 of switch 112 to its forward position "FP" and rearward position "RP" by the operator when moving iron 100 forwardly and rearwardly correspondingly changes the forward and rearward angled positions of vibration device 108, such that iron 100 always functions to apply at least some vertical component of vibration to compact the substrate to be ironed, while at the same time applying a force vector in either the forward or rearward direction to assist movement of iron 100 across the surface of the substrate that is ironed, thereby providing an enhanced ergonomic operation for the user.

Additional experiments were conducted by the present inventor using irons having vibration devices affixed thereto in a manner similar to that shown in FIGS. 5A and 6A and described above, but including a first iron having a vibration device mounted to produce vibrations in a forwardly angled plane, and a second iron having a vibration device mounted to produce vibrations in a rearwardly angled plane. It was found that the vibration device of the first iron drove the iron in a forward direction while the vibration device of the second iron drove the iron in a rearward direction, with both irons demonstrating increased compaction of fabric substrates that were ironed versus use of control irons that lacked vibration devices.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ironing appliance, comprising:

a body including a handle and an iron sole;

a vibration device coupled to said iron sole, said vibration device movable between a first nominal position in which said vibration device transmits vibrations to said iron sole within a vertical plane and a second nominal position in which said vibration device transmits vibrations to said iron sole within a non-vertical plane; and a user-operable switch associated with said handle, said switch actuable to move said vibration device between said first and second nominal positions.

2. An ironing appliance, comprising:

a body including a handle and an iron sole;

a vibration device coupled to said iron sole, said vibration device movable through a range of orientations that are displaced with respect to a vertical position in which said vibration device transmits vibrations to said iron sole within a vertical plane; and a user-operable switch associated with said handle, said switch actuable to move said vibration device through said range of orientations, said switch movable between a forward position and a rearward position to move said vibration device between respective orientations disposed forwardly of said vertical position and rearwardly of said vertical position.

3. The ironing appliance of claim 1, wherein said switch comprises a slide member slidably coupled to said handle.

4. The ironing appliance of claim 1, wherein said vibration device operates at a frequency of at least 1,000 rpm.

5. The ironing appliance of claim 2, wherein said switch comprises a slide member slidably coupled to said handle.

6. The ironing appliance of claim 2, wherein said vibration device operates at a frequency of at least 1,000 rpm.

7. An ironing appliance, comprising:

a body including a handle and an iron sole;

a heating device associated with said iron sole; and a vibration device separate from said heating device, said vibration device coupled to said iron sole.

8. The ironing appliance of claim 7, further comprising a switch associated with said handle, said switch operable to vary a nominal position of said vibration device.

9. The ironing appliance of claim 8, wherein said switch comprises a slide member slidably coupled to said handle.

10. The ironing appliance of claim 7, wherein said vibration device operates at a frequency of at least 1,000 rpm.

* * * * *